United States Patent [19]

Curtis et al.

[11] Patent Number: 4,869,693

[45] Date of Patent: Sep. 26, 1989

[54] COWL AND AIR INLET ASSEMBLY

[75] Inventors: Mark D. Curtis, Oshkosh; David W. Heidel, Green Lake, both of Wis.

[73] Assignee: Brunswick Corporation, Skokie, Ill.

[21] Appl. No.: 235,913

[22] Filed: Aug. 24, 1988

[51] Int. Cl.[4] ..... B63H 21/24

[52] U.S. Cl. ..... 440/77; 123/195 P

[58] Field of Search ..... 440/76, 77; 123/195 P, 123/195 C, 198 E

[56] References Cited

U.S. PATENT DOCUMENTS 3,358,668 12/1967 Post et al. ..... 440/77

3,955,526 5/1976 Kusche ..... 123/195 P 4,600,396 7/1986 Crane et al. ..... 440/77

4,723,927 2/1988 Walsh et al. ..... 440/77

*Primary Examiner*—Joseph F. Peters, Jr.

*Assistant Examiner*—Jesûs D. Sotelo

*Attorney, Agent, or Firm*—Andrus, Sceales, Starke & Sawall; Robert C. Curfiss

[57] ABSTRACT

A cowl and air inlet assembly for a marine outboard engine has a first cowl half having an edge portion with a tongue extending from the edge and a second cowl half having an edge portion with a groove for receiving the tongue of the first cowl half when the two halves are joined. A bonding material is disposed along the joint formed by the tongue and groove to permanently join the two cowl halves.

7 Claims, 2 Drawing Sheets

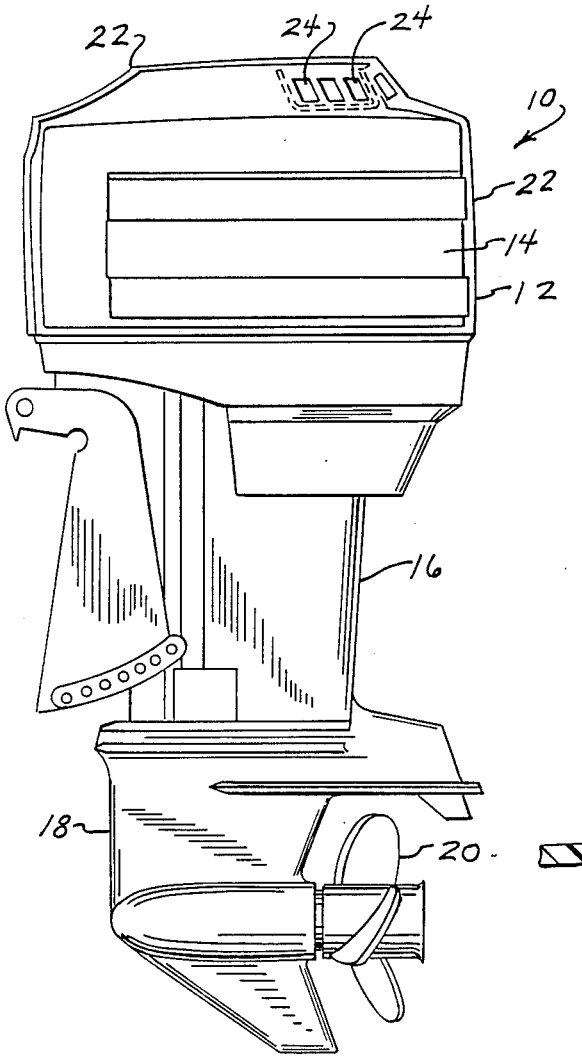
FIG. 1
FIG. 6
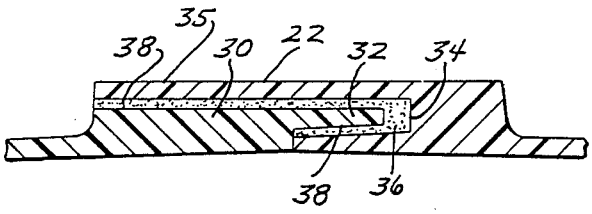
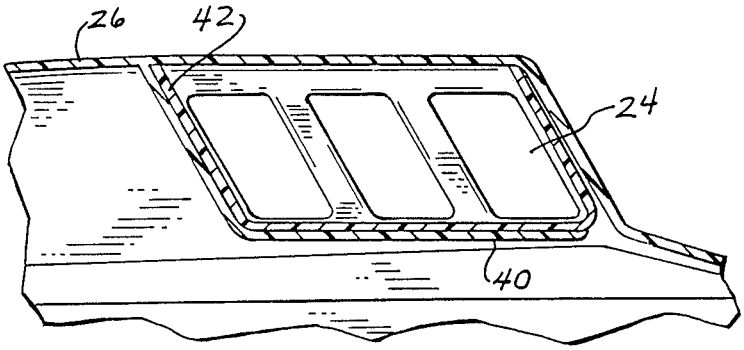
FIG. 5

COWL AND AIR INLET ASSEMBLY

BACKGROUND OF THE INVENTION

The present invention relates to a cowl for a marine outboard engine and more specifically to a two piece cowl assembly including an air inlet retaining structure.

In the past, the applicant and other marine outboard manufacturers have provided a cowl for outboard engines that utilized a "clam shell" design. Such cowls have now been replaced by "bucket" cowls. However, it is desirable to retain the unique shape and design of the cowl since the styling of the cowl generates a considerable amount of customer appeal and in the case of the applicant, the styling of the cowl have achieved trademark significance.

When going to the "bucket" cowl, it was found that the classic style could not be retained in a molded one piece cowl. Therefore, it was necessary to design a two piece cowl assembly. The resulting two piece cowl also allowed for a mechanically trapped air inlet which eliminated the need for fasteners that were typically utilized in installing the air inlet in a one piece cowl.

SUMMARY OF THE INVENTION

A cowl and air inlet assembly for a marine outboard engine includes a first cowl half having an edge portion with a tongue extending from the edge portion.

In accordance with one aspect of the invention, a second cowl half is provided which has an edge portion with a groove for receiving the tongue of the first cowl half when the two halves are joined.

In accordance with another aspect of the invention, a bonding material is disposed along the joint formed by the tongue and groove to permanently join the first and second cowl halves.

In accordance with yet another aspect of the invention, the cowl halves are provided with supports disposed on their inner surfaces which mechanically trap and hold an air inlet box.

The present invention thus provides a bonded two piece "bucket" cowl that retains all of the styling characteristics associated with a one piece "clam shell" design.

The present invention also provides a method of mechanically trapping the air inlet box within the cowling so that the fasteners typically associated with the assembly of the air box can be eliminated.

BRIEF DESCRIPTION OF THE DRAWINGS

The drawings illustrate the best mode presently contemplated of carrying out the invention.

In the drawings:

FIG. 1 is a side elevational view of a marine outboard engine having a cowl constructed according to the present invention;

FIG. 5 is a sectional view taken along the line 5—5 of FIG. 3; and

FIG. 6 is a side cross sectional view of the tongue and groove assembly utilized for securing the two cowl halves.

DESCRIPTION OF THE PREFERRED EMBODIMENT

Figure 2:
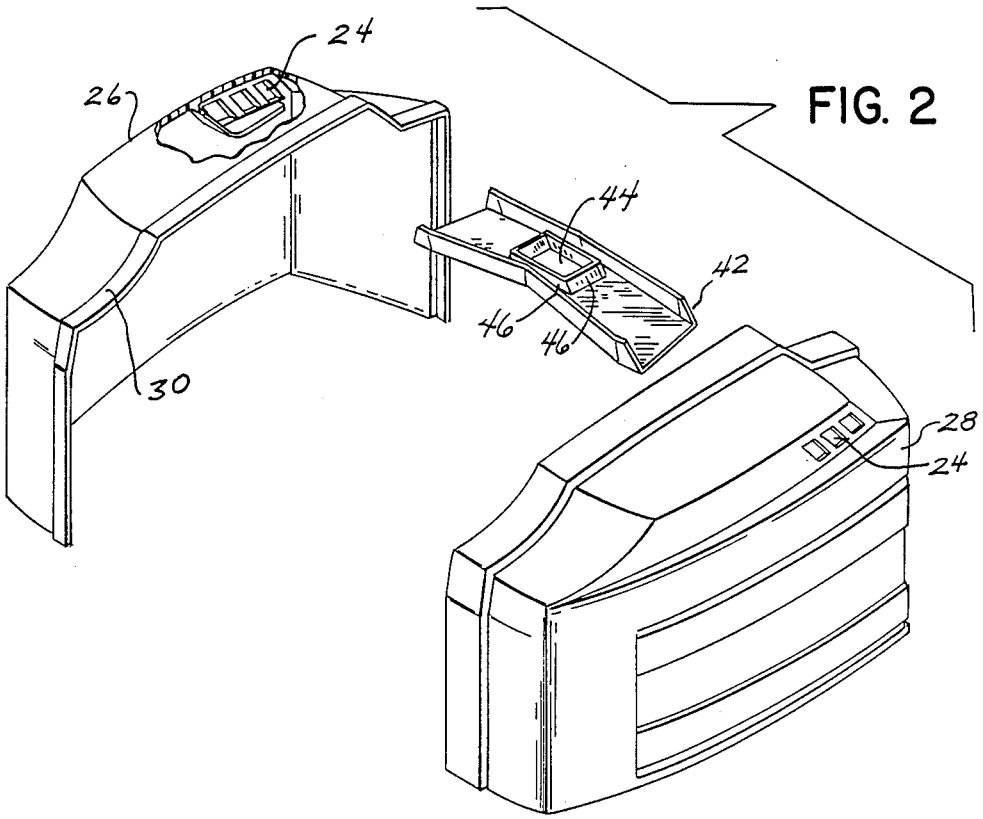
FIG. 2 is an exploded perspective view of a cowl and airbox assembly constructed according to the present invention.

As shown in FIG. 1, a marine outboard engine 10 includes a power head 12 having a covering cowl 14, a drive shaft housing 16, and a lower unit 18 including a propeller 20. Cowl 14 is provided with a number of decorative and asthetic features including a centrally located ridge 22. Cowl 14 is also provided with a number of air inlet openings 24 which provide air for the operation and cooling of the engine.

Cowl 14 is formed by the joining of a first cowl half 26 and a second cowl half 28. Cowl half 26 is provided with a raised inner edge 30 that includes an outwardly extending tongue 32.

Second cowl half 28 is similarly provided with a raised inner edge 34 having a groove 36 which receives tongue 32 when cowl halves 26 and 28 are joined. Edge 34 is also provided with an upper extension 35 that overlaps tongue 32 and edge 30 to define centrally disposed ridge 22 mentioned earlier.

A bonding material 38 is disposed along the tongue and groove juncture so that the cowl halves will be permanently joined and sealed.

Figure 3:
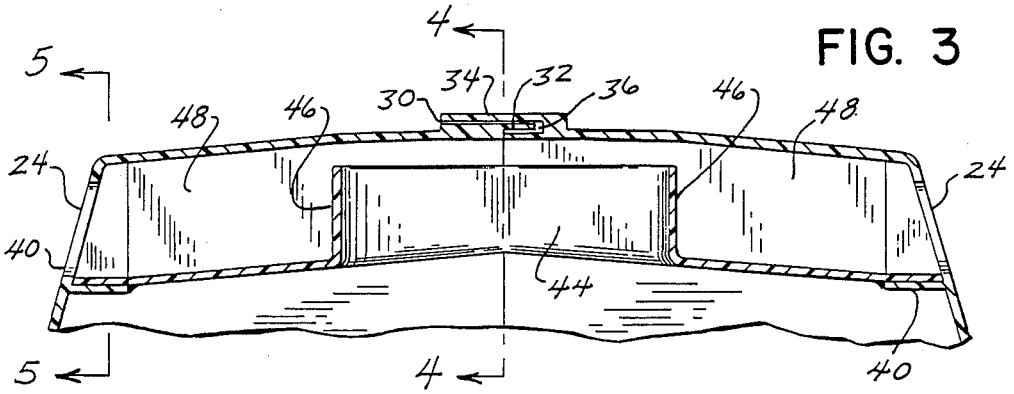
FIG. 3 is a front cross sectional view of the upper portion of the cowl and airbox assembly.
Figure 4:
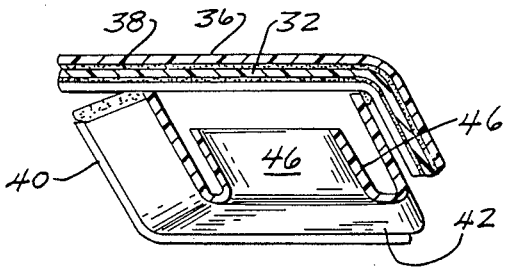
FIG. 4 is a sectional view taken along the line 4—4 of FIG. 3.

As best seen in FIGS. 3 and 5, the inner surface of each of cowl halves 26 and 28 is provided with an inwardly extending flange 40 that forms a support for an air box 42.

Air box 42 is the form of a trough having a centrally located opening 44 surrounded by a plurality of raised sidewalls 46. When assembled within the cowl, air box 42 cooperates with the cowling to define a passageway 48 that communicates air inlet openings 24 with centrally located opening 44.

Thus, air is provided to the interior of power head 12 via inlet openings 24, passageway 48 and central opening 44.

If desired, a bonding material may be applied along the seam formed by flange 40 and air box 42. Air box 42 is thus mechanically trapped within cowl halves 26 and 28 and it becomes unnecessary to provide fasteners such as screws or rivets to hold air box 42 in position.

It is recognized that various alternatives and modifications are possible in the scope of the appended claims.

We claim:

1. A cowl and air inlet assembly for a marine outboard engine comprising:

a first cowl half having an edge portion with a tongue extending from said edge portion, a second cowl half having an edge portion with a groove for receiving said tongue when said first and second cowl halves are joined, and bonding material disposed along the joint of said tongue and groove to permanently join said first and second cowl halves.

2. The cowl and air inlet assembly defined in claim 1 wherein said groove containing edge includes an upper extension which overlaps said tongue containing edge portion.

3. The cowl and air inlet assembly defined in claim 1 wherein said edge portions are raised froom the cowl surfaces so that the joining of said edge portions forms a centrally disposed ridge along the cowl assembly.

4. The cowl and air inlet assembly defined in claim 1 wherein said first and second cowl halves have a plurality of vent openings and further comprising:

support means disposed on the inner surfaces of said first and second cowl halves and an air box disposed on said support means and defining a passageway communicating said vent openings with an opening in said air box communicating with the interior of the cowl assembly.

5. The cowl and air inlet assembly defined in claim 4 wherein said support means comprises a flange disposed adjacent said vent openings and extending inwardly from said inner surface of said cowl half.

6. The cowl and air inlet assembly defined in claim 4 wherein said air box comprises a trough having centrally located opening with said opening surrounded by a plurality of raised sidewalls.

7. A cowl and air inlet assembly for a marine outboard engine comprising:

a first cowl half having an edge portion with a tongue extending from said edge portion, a second cowl half having an edge portion with a groove for receiving said tongue when said first and second cowl halves are joined, bonding material disposed along the joint of said tongue and groove to permanently join said first and second cowl halves, said first and second cowl halves having a plurality of vent openings with support means disposed on the inner surfaces of said cowl halves adjacent said vent openings, and an air box disposed on said support means and defining a passageway communicating said vent openings with an opening in said air box communicating with the interior of the cowl assembly.

* * * * *